United States Patent [19]

Haefner

[11] Patent Number: 4,795,136

[45] Date of Patent: Jan. 3, 1989

[54] APPARATUS FOR ERECTING FORMS

[76] Inventor: Joseph F. Haefner, 370 Iroquois Ave., Pittsburgh, Pa. 15237

[21] Appl. No.: 5,847

[22] Filed: Jan. 21, 1987

[51] Int. Cl.[4] ..... B66D 1/36

[52] U.S. Cl. ..... 254/336; 254/376; 425/63

[58] Field of Search ..... 254/329, 334, 335, 336, 254/338; 52/123.1, 111; 425/63; 249/20, 21, 22

[56] References Cited

U.S. PATENT DOCUMENTS

| | | | |
|---|---|---|---|
| 732,167 | 6/1903 | Canfield | 249/22 |
| 947,160 | 1/1910 | Newerf | 425/63 |
| 2,516,318 | 7/1950 | Hawes | 425/63 |
| 2,825,115 | 3/1958 | Williams | 254/334 X |
| 3,295,266 | 1/1967 | Van Bijlevelt | 52/125.1 |
| 3,328,859 | 7/1967 | Stevens | 52/125.6 |
| 3,585,092 | 6/1971 | Storer | 52/749 |
| 3,628,223 | 12/1971 | Babee | 425/65 |
| 3,778,204 | 12/1973 | Kuck | 425/63 |
| 3,863,418 | 2/1975 | Faucheux | 52/745 |
| 4,122,648 | 10/1978 | Godwin | 52/749 |
| 4,221,537 | 9/1980 | Mamula et al. | 414/786 |
| 4,301,630 | 11/1981 | Burkland | 52/125.1 |

*Primary Examiner*—Stanley N. Gilreath
*Assistant Examiner*—Katherine Matecki
*Attorney, Agent, or Firm*—Dowell & Dowell

[57] ABSTRACT

A form erection hoist for use with concrete building forms or panels has a support which engages the top or an intermediate rib of an erected form. A column is rigidly attached to the support and extends above and below it. A support for a central and an outboard sheave is mounted on the upper end of the column. A cable reel support is mounted on the lower end of the column and engageable selectively between the sides of an erected form. Cable from the reel extends around the two sheaves and downwardly to engage the handle of a form to be raised into position alongside the previously erected form or to be lowered when no longer needed. The sheave support is shiftable to extend outboard of either side of an erected form. The hoist is lightweight and may be handled and operated by a single person with minimal risk of injury.

10 Claims, 5 Drawing Sheets

APPARATUS FOR ERECTING FORMS

BACKGROUND OF THE INVENTION

1. Field of the Invention

This invention relates to the construction industry and more particularly to apparatus and procedures for erecting and removing building forms of the kind that are positioned for the pouring of concrete therebetween to form walls.

2. Description of the Prior Art

In the construction of forms for poured concrete walls it is the practice to erect a double line of forms or panels at ground level which are connected to each other and held in place by ground braces. After erecting and stabilizing the ground level forms, a second row of forms is ordinarily mounted directly above the first row and so on depending upon the height of the wall. In order to erect the second row of forms, it is necessary to install scaffolding just below the level of the top of the first row. Raising the forms above the ground level to the second and any upper levels ordinarily requires the use of suspended platforms and slings for workmen and is hazardous. Furthermore, the erection of panels at the higher levels requires the use of two or more workmen in order to lift and position the panels at the higher levels.

The patent to Babee, U.S. Pat. No. 3,628,223, describes the use of a climbing form hoist for raising a form panel progressively up a concrete wall under construction. The hoist includes a mast which is driven by an electric motor to raise and lower the form panel.

SUMMARY OF THE INVENTION

It is an object of the present invention to provide form erection apparatus and procedure to facilitate the erection and removal of forms in the concrete wall construction industry.

It is a further object of the invention to provide form erection apparatus which will permit a single carpenter or workman to erect and remove forms above the ground level rapidly and with a high degree of safety.

The apparatus of the present invention includes a form hoist having a supporting element which engages the top or intermediate rib of a previously erected form, the support having a column rigidly attached thereto and which extends above and below the hoist. At the level above the hoist, a sheave support is mounted for carrying a cable laterally of the form in order that it may engage and lift a new form into place above an adjacent form. At the lower end of the column, a cable supply and operating means is provided whereby an operator may control the feed of the cable. The apparatus is lightweight so that it may be easily placed in position from below by an operator, used by him to raise and lower forms as required, and removed, all without requiring the assistance of anyone else.

DESCRIPTION OF THE PREFERRED EMBODIMENT

Figure 1:
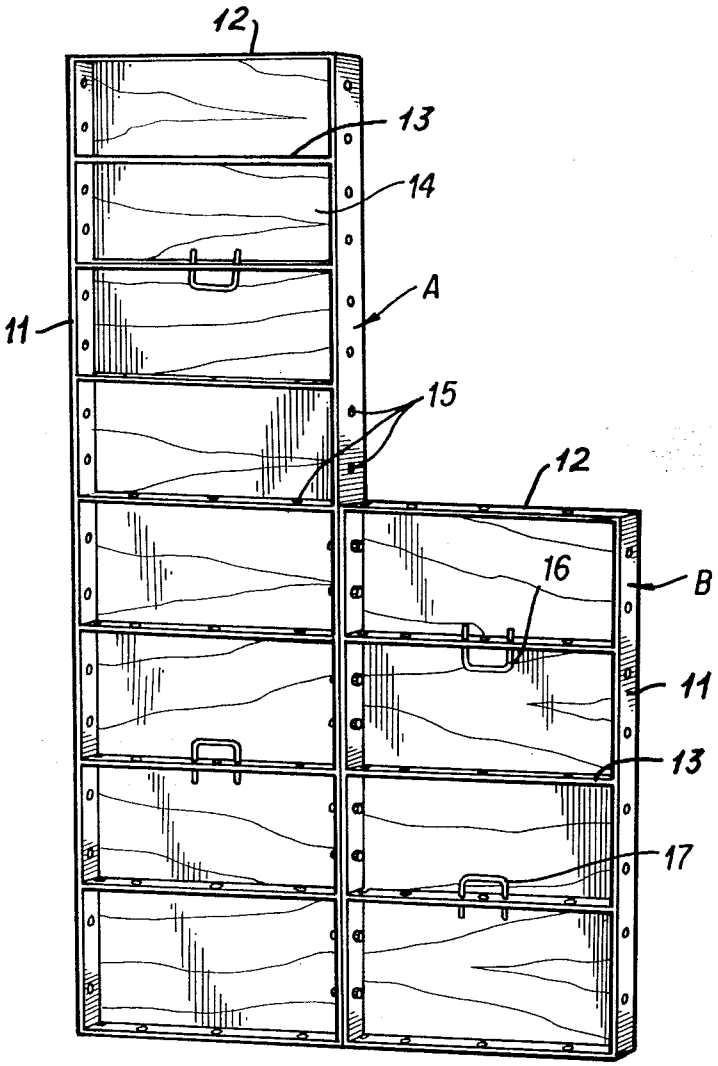
FIG. 1 is a perspective of a pair of conventional concrete forms side by side, one being of greater height than the other.

FIG. 1 illustrates a pair of conventional forms or panels A and B having side flanges 11, end flanges 12 and intermediate reinforcing ribs 13 providing a frame for a panel member 14 at the back of each of the forms. The panels may be of various dimensions, panel A conventionally being 8 feet long by 2 feet wide and panel B being 4 feet long by 2 feet wide. The side and end flanges and reinforcing ribs are provided with openings 15 for receiving pins or wedges to connect them to other panels, the openings in the end flanges also providing in the present case for interconnection with the support means of the hoist of the present invention. Each of the panels is also provided with handles 16 and 17 by means of which they may be carried.

The hoist of the present invention includes a primary support assembly 20 including an angle member 21 which extends laterally to either side of a column 22 to which it is fastened by a clamp 23 held by fastening means 24.

Adjacent to each end of the angle members 21, a box strut 25 is attached to the upright portion 21' of the angle member by suitable fastening means 26, such box strut extending upwardly parallel to the column 22 for purposes which will be described later.

At the outer ends of the arm 21, an adjustable finger 27 is mounted by bolt 28 and thumb screw 29, the adjustable finger being mounted beyond the extent of the upright portion 21' of the arm 21 in order that it may be positioned on either side of the horizontal portion 21'' of the arm 21 as well as extending over the end thereof.

Mounted intermediate each end of the arm 21 and the column 22 is a wedge anchor or fixed finger 29 which is held by suitable fastening means 30 and extends downwardly through opening 31 in the horizontal portion of the arm 21.

The support assembly 20 may be placed on an end flange with the fixed fingers 29 extending downwardly through openings therein, and the adjustable fingers 27 extending over and engaging the back edge of the end flange in order to stabilize the support assembly on the frame. Alternatively, the assembly 20 may be placed on an intermediate flange with the adjustable fingers extending over and engaging the front edge of such flange.

Moving upwardly from the main support assembly 21 and with particular reference to FIGS. 2, 3, 4, 7 and 8, a sheave support assembly 40 is illustrated. The sheave support assembly includes a main portion 41 providing the horizontal leg 42 of an angle member having a vertical leg 43. Column 22 is secured to leg 43 by clamp 46 having fastening means 47.

The box strut members 25 are connected to the horizontal leg by means of plates 32 that are welded to the edge of the horizontal portion 42. Thus, the sheave support assembly 40 is carried both by the column 22 and by the box strut members 25.

In order to support a sheave arm on the sheave support assembly 40, a pair of brackets 50 and 51 are mounted on the wall 43 of the angle support member. Each of the brackets is approximately Z-shaped in structure having a foot portion 52 attached to the upright portion 43, an outwardly projecting portion 53, and an angularly disposed portion 54 which is connected to an ear 55 extending outwardly of each end of the angle member 41. In order to facilitate the mounting of the sheave arm thereon, bolts 56 and 57 are permanently fastened through the portions 54 of the brackets 50 and extend outwardly therefrom.

A sheave arm 60 is selectively mountable on the bolts 56 and 57, being held thereto by nuts 58. The sheave arm 60 carries at its ends rotatably mounted sheaves 61 and 62, the sheave 61 being positioned substantially centrally of the sides of the form on which it is supported and the sheave 62 overlying the central portion of an adjacent form.

Figure 3:
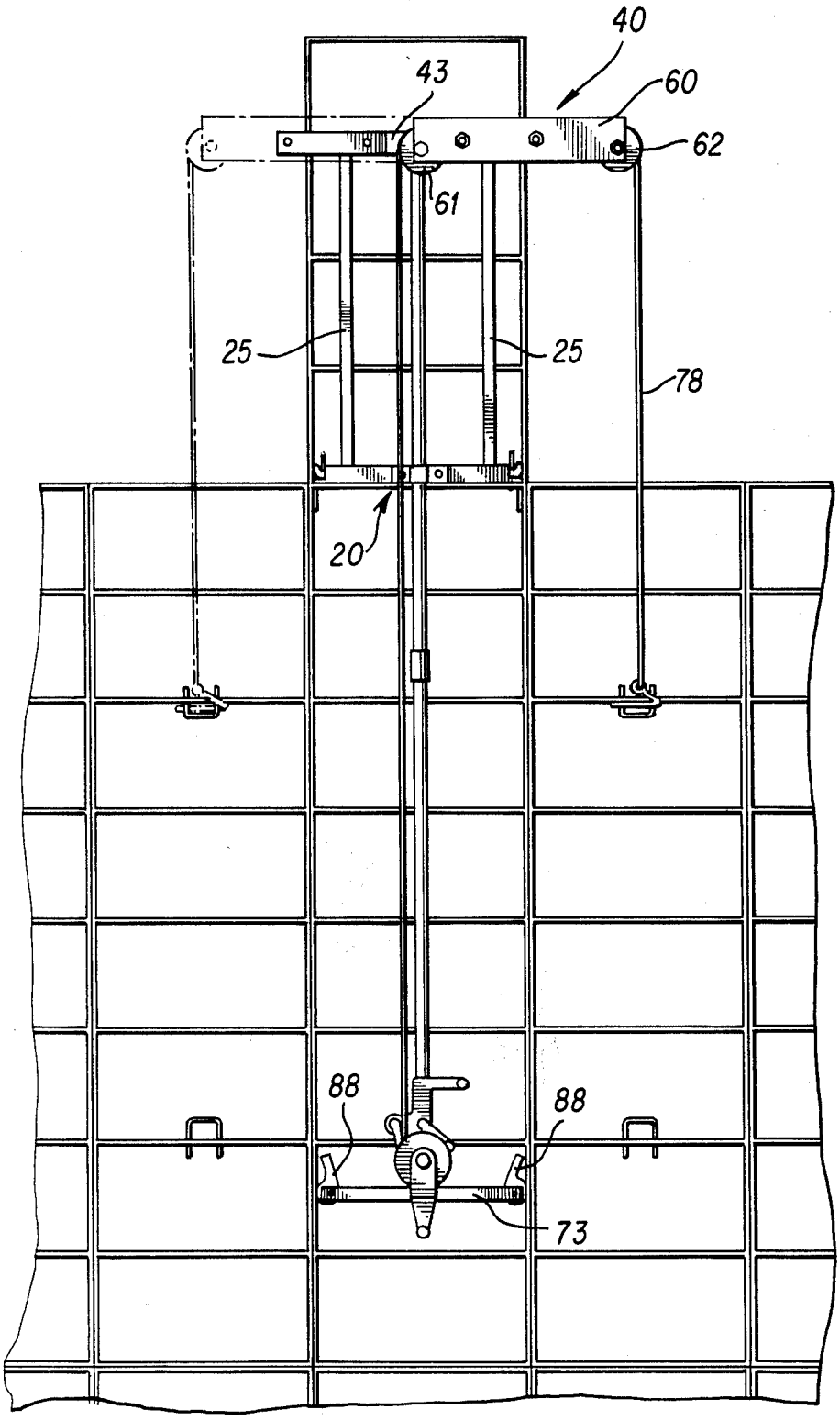
FIG. 3 is a front view of apparatus of the present invention mounted in position on a form and illustrating in whole and broken lines the alternate positioning of the sheave arm for engaging a form on either side of the form on which the hoist is mounted.

As indicated in FIG. 3, the sheave support may be mounted on either bracket 54 in order that it may support a sheave over either side of the column.

The column 22 extends downwardly to a cable drum assembly 70. The cable drum assembly is carried on the column by an elongated collar 71 having fasteners 72 and which is connected to a cross support member 73 by a clamp 74 having fasteners 75. The assembly includes a shaft 76 carrying a reel 77 with a cable 78 wound thereon and operable by a crank handle 79.

In order to control the operation of the reel, a ratchet and pawl is provided including a circular ratchet member 80 engagable by a pawl 81 which is connected to a pin 82 carried by the collar 71. The pin also provides the pivot for a lever 83 of a brake strap 84 which is carried at one end on a movable pin 85 of the lever and supported at its other end on the pin 82. Lever 83 is provided with a handle 86.

The support member 73 is of a length to just fit within the sides of the frame. Each end is removably held thereto by a cam 88 carried by pin 89 and having an operating lever 90. It will be apparent therefore that after the main support is secured to an end or an intermediate rib of the frame that the column may depend therebeneath and be engaged in any selected position by means of the cams 88.

The end of the cable is provided with an eye 91 carrying a loop hook 92 for removably engaging one of the handles 16 of a frame.

In the construction of concrete walls for a building, it is contemplated that the first row of panels will be erected from the ground and tied together with the customary rods as is conventional in the art. Such first row may include one or more panels of shorter height than the remainder as a staggered arrangement may be preferred in some cases. Thus, an example of a first row of panels (see FIG. 7) may be three 8 foot panels, a 4 foot panel with an 8 foot panel on top, then three more 8 foot panels, a 4 foot panel and so on.

Figure 4:
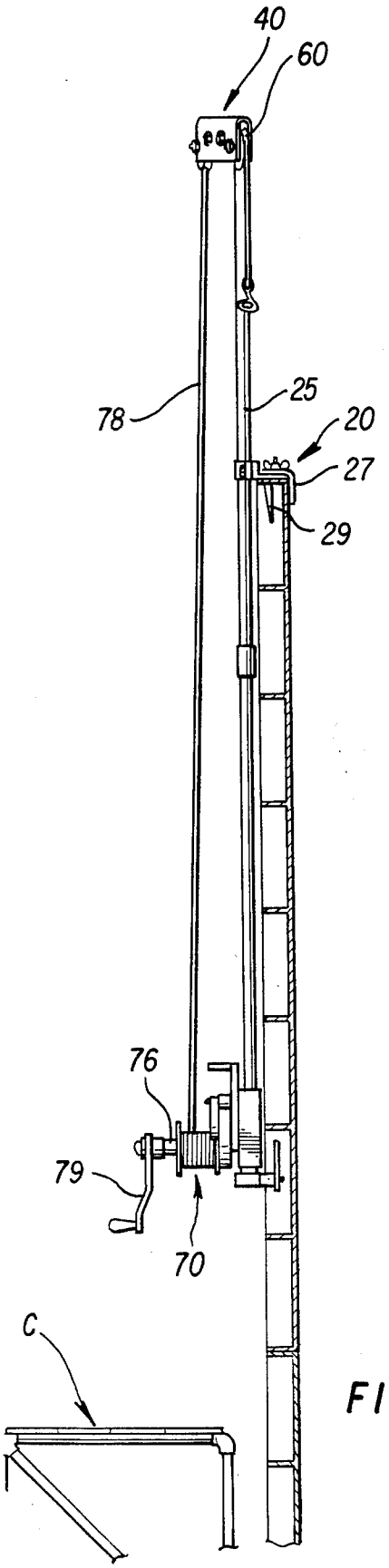
FIG. 4 is a view, partly in section, to an enlarged scale, on the line 4—4 of FIG. 7.
Figure 5:
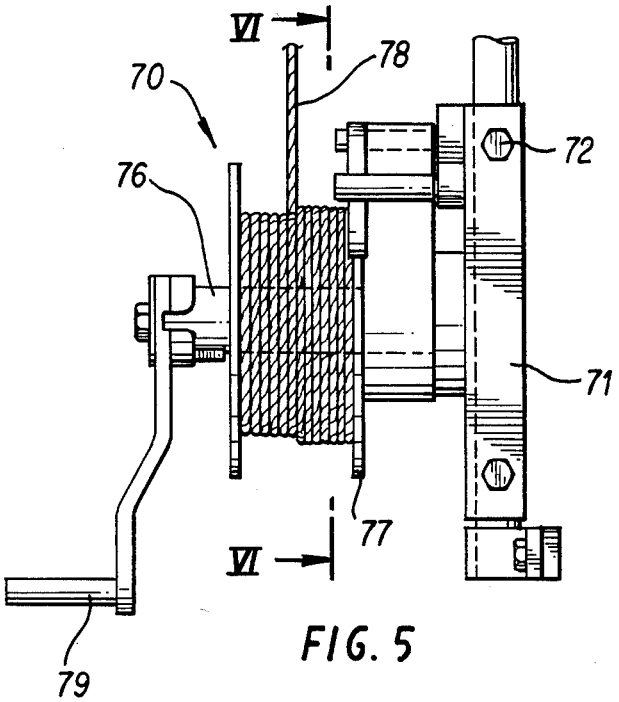
FIG. 5 is an enlarged side elevation of the cable reel assembly illustrated in FIG. 4.
Figure 6:
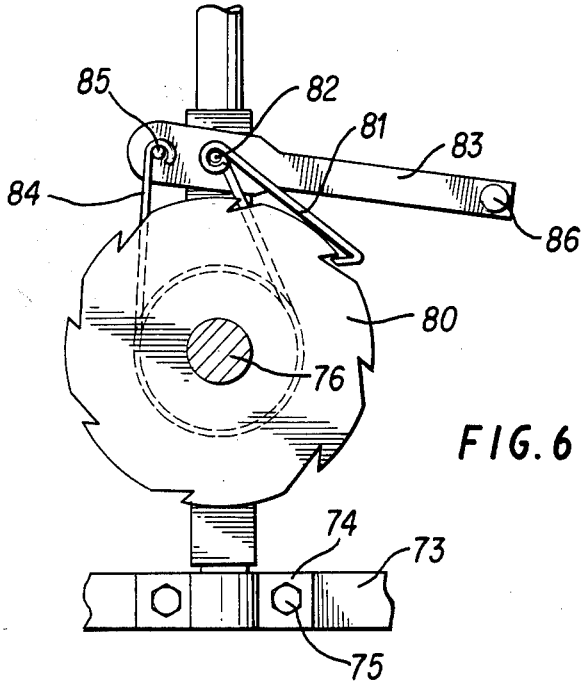
FIG. 6 is a section on the line 6—6 of FIG. 5.
Figure 7:
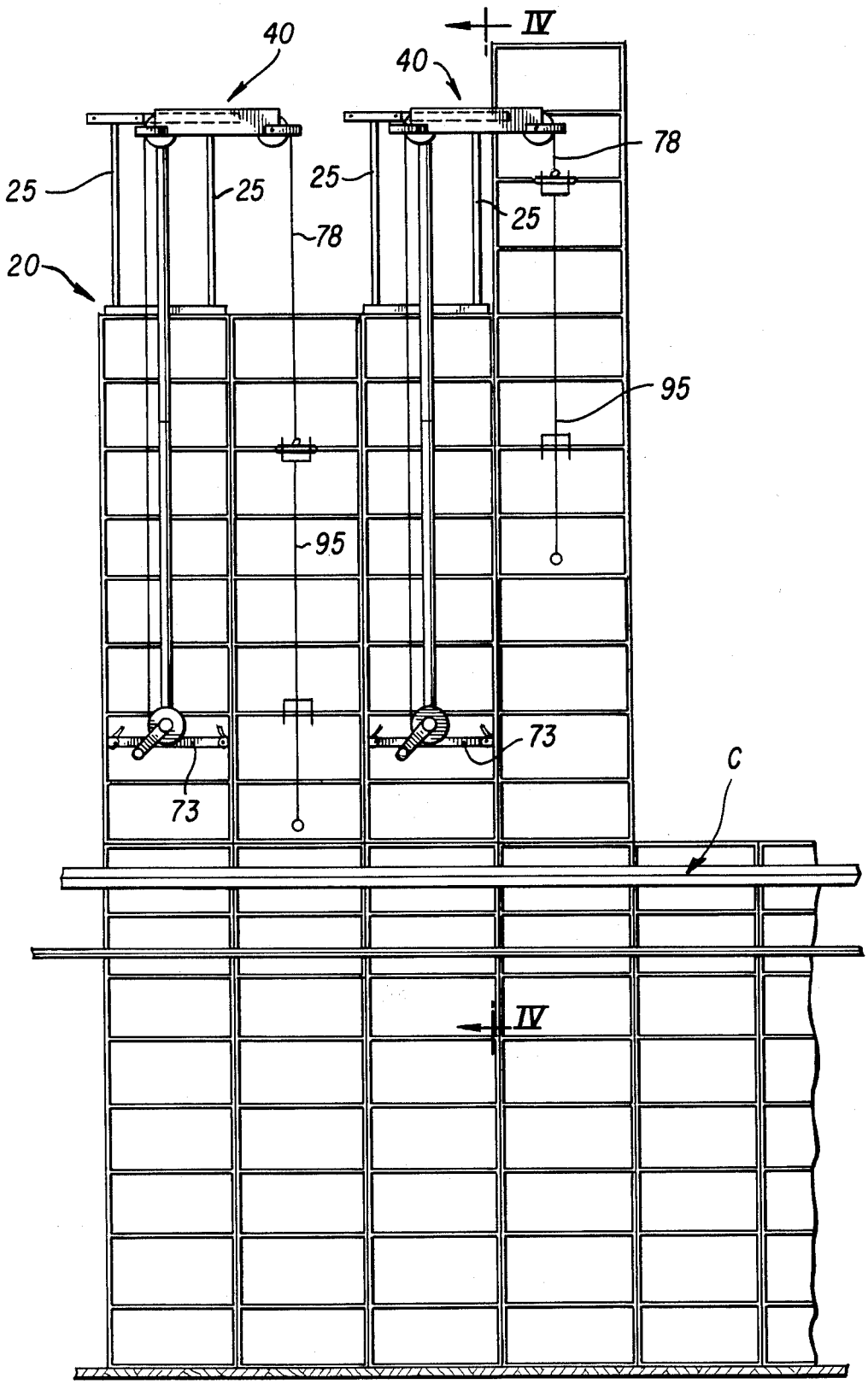
FIG. 7 is a front view illustrating the raising of panels at different heights, the underlying panel at the right being offset at a higher elevation than the adjacent underlying panels.

After the first row is erected from the ground with the whalers and braces for stabilizing, the scaffold brackets C are installed, customarily 18 inches below the top of the 8 foot panels (see FIGS. 4 and 7). The scaffold provides a place for a workman to stand during use of the device of the present invention. The first panel of the second row is then erected by conventional means. It is at this point that the equipment of the present invention is brought into use.

Figure 2:
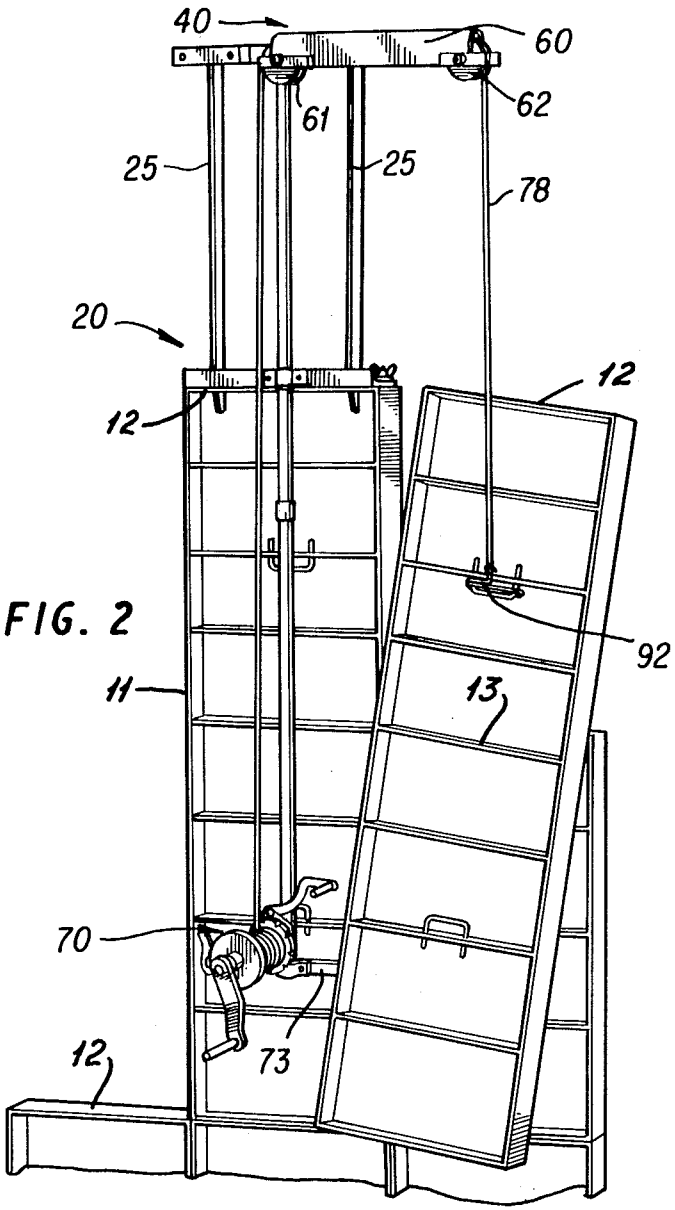
FIG. 2 is a perspective of apparatus in accordance with the present invention mounted on a concrete form and in the process of raising a form into position.

Prior to installing the equipment, the next panel to be raised is placed on the ground in position to be picked up by the hoist. The workman then positions the hoist equipment on top of a form on an end flange such as indicated in FIG. 2. He does this by standing on the scaffold and by holding the column and cable reel assembly he raises the support assembly 20 into position centrally on the upper end flange and then brings it down onto it in such a way that the wedge anchors 29 enter and engage the openings on either side of the center part of the end flange. At the same time, the adjustable fingers 27 engage over the back of the flange. This securely positions the support 20 on the end flange of the frame. After the support member 20 is positioned in place, the cable reel assembly support arm 73, which is then positioned between the sides of the form, is fixed in position by operation of the cams 88.

With the sheave arm 60 in the appropriate position, right or left, as indicated in FIG. 3, the cable reel is then operated to let the cable down in order that the workman may engage the hook 16 over the handle 92 of the panel that is to be raised from the ground. At this time, the panel may be raised as indicated in FIG. 2 until its lower end flange engages the upper end flange of the panel onto which it is being placed. Using the appropriate pins and conventional connecting means, the new panel may then be secured to the adjacent panel and to the panel beneath it.

A tag line 95 (see FIG. 7) is ordinarily connected to the hook 16 prior to its being engaged with the handle to assist in positioning the cable and also in order that the operator may pull down on it to release it from the handle after the panel is secured in place.

After the newly erected panel is secured in place, the workman releases the pawl 81 and pulls down on the tag line to release the hook from the handle 92. The workman may then raise the column in order to release the support 21 from the end flange of the previously erected form.

In operating the cable reel, the operator uses the pawl and ratchet in order to secure the form in a selected position. At the same time, the brake 84 assists him in controlling the operation of the reel. The workman may then shift the support assembly 20 onto the top or end flange of the form which he has just erected in order to erect another form next to it. In the event that there is a difference in the height of the forms, the workman may position the support 20 on any intermediate rib of a form by the same procedure.

Figure 8:
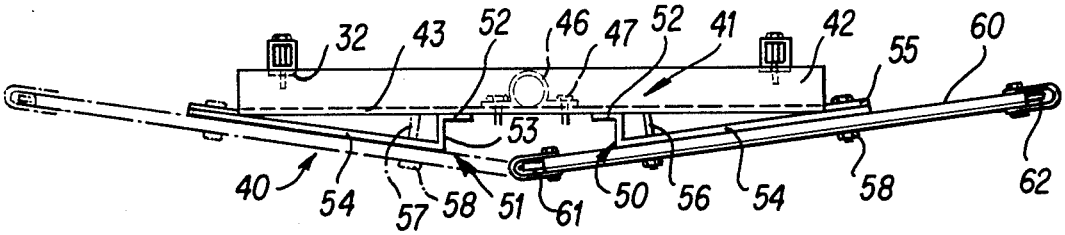
FIG. 8 is a top plan view, to an enlarged scale, of the sheave support assembly.
Figure 9:
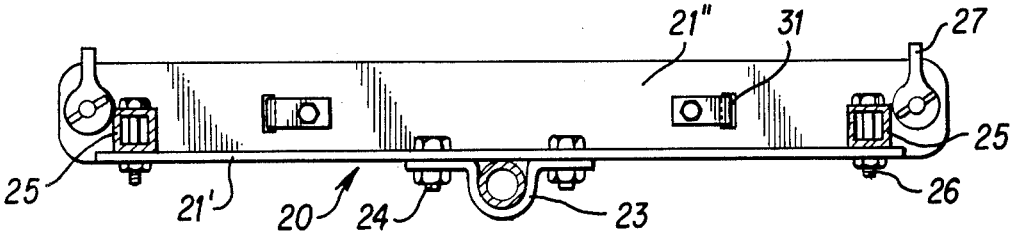
FIG. 9 is a top plan view, to an enlarged scale, of the primary support assembly, and showing its connection to the support columns.
Figure 10:
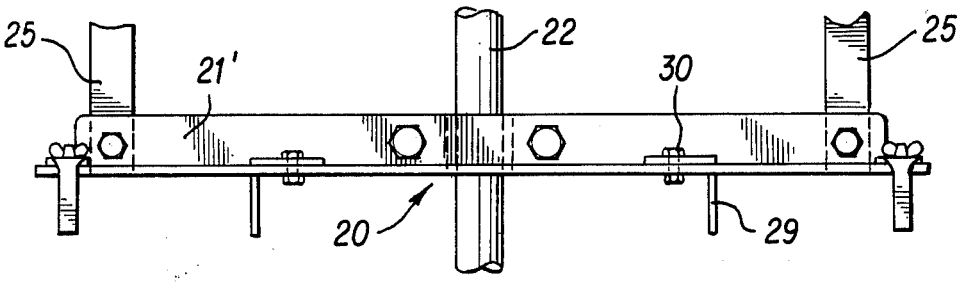
FIG. 10 is a rear elevation of the structure of FIG. 9.
Figure 11:
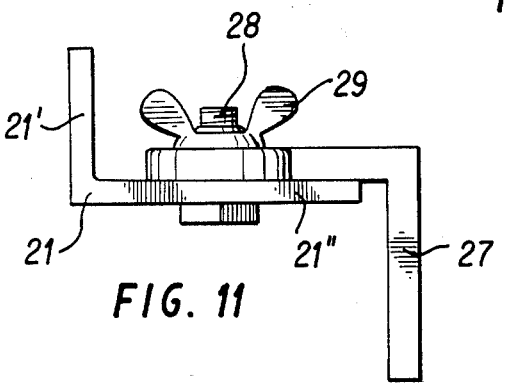
FIG. 11 is an enlarged detail of the adjustable finger means illustrated in FIG. 10.
Figure 12:
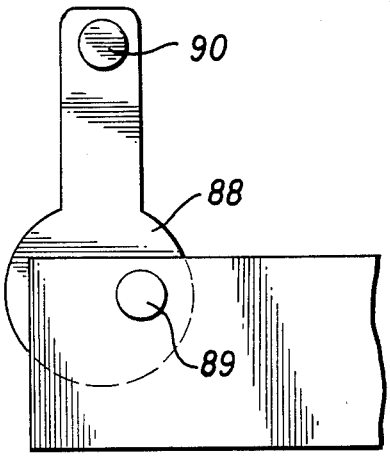
FIG. 12 is an enlarged detail of a cam mounted on an end of the cable drum assembly support arm.
Figure 13:
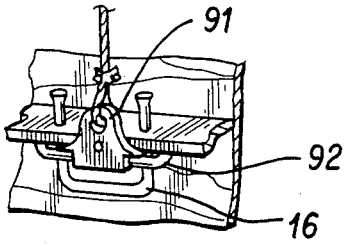
FIG. 13 is an enlarged perspective of the handle and hook interconnection.

Instead of working on the right hand side of the form as pictured in FIG. 2, the workman may swing the sheave mechanism to the other side as indicated in phantom in FIGS. 3 and 8. The sheave support arm can be removed from the bolts on which it is mounted on the bracket on the other side of the main column.

When the sheave arm is changed from one side of the support to the other, it is turned through 180° thereby keeping the central sheave 61 in the proper position for winding on the reel. It will also be appreciated that the winch, the brake, and the safety pawl may be reversed.

After the concrete wall has been poured and set, the forms may be removed by a reverse process from that of erection. Thus, the support assembly 20 is mounted on top of the form adjacent to that which is to be removed and the hook is engaged with the handle of the form to be removed in order to lift it from engagement with the form immediately beneath it and it is then lowered to the ground. One difference, however, is in the position of adjustable fingers 27. During the stripping operation, these are reversed and extend over the front part of the panel since they would not be able to extend into the concrete wall, except for the offset panel which extends above the poured concrete wall, as indicated in FIG. 7, in which the case the adjustable fingers may be in their original position.

I claim:

1. A form erection hoist for use with concrete building forms wherein the forms having a main body of sheet material, side and end flanges, and spaced lateral reinforcing ribs, said hoist comprising a first support assembly having means for engaging an end flange of an erected form, column means rigidly connected to said first support assembly and having an upper end extending above and having a lower end extending below said first support assembly, sheave support means connected to said column means adjacent said upper end thereof and in spaced relation from said first support assembly, said sheave support means extending perpendicularly to said column means and substantially parallel to said first support assembly, second support means rigidly connected to said column means adjacent said lower end thereof, means for selectively mounting said second support means between the side flanges of an erected form in a selected position, cable supply means mounted on said second support means, said sheave support means having inner and outer portions, a first sheave mounted to said inner portion of said sheave support means in vertical alignment with said cable supply means, a second sheave mounted to said outer portion of said sheave support means and horizontally spaced from said first sheave, said cable supply means having a cable extending upwardly around said first and outwardly around said second sheaves to an end portion and form engaging means carried by said end portion of said cable.

2. The invention of claim 1, in which said column means includes a central column and a pair of auxiliary struts, one on each side thereof, spaced from the central column, each of said auxiliary struts extending from said first support assembly to said sheave support means.

3. The invention of claim 1, in which said cable supply means is a cable drum.

4. The invention of claim 3, said cable drum having pawl and ratchet means, and brake means, for controlling the winding of cable on said drum.

5. The invention of claim 4, including means for reversing the operation of said cable drum, said pawl and ratchet means, and said brake means.

6. The invention of claim 1, in which the side and end flanges and reinforcing ribs have spaced openings for receiving connecting pins used to join the forms in assembled relationship, said first support assembly having fixed finger means adapted to be received in the openings in the end flanges for positioning said first support assembly on an end flange, said first support assembly having adjustable finger means movable between a first position and a second position whereby said adjustable finger means may be used to stabilize said first mounting assembly when the hoist is in use.

7. The invention of claim 6 in which said form engaging means comprises means for engaging a handle on a form.

8. The invention of claim 1 in which said sheave support means includes a main portion having outer ends and a central portion, a pair of spaced bracket means, each of said bracket means extending from an outer end of said main portion and inwardly towards its central portion and being spaced laterally therefrom at its central portion, said bracket means being in spaced relation from each other, each of said bracket means having mounting means, said sheave support means including a sheave arm, said sheave arm being mountable on either of said bracket means, and said first and second sheaves being mounted to said sheave arm.

9. A combination erection hoist and concrete building forms comprising each of said forms having a main body of sheet material, side and end flanges, a central portion and spaced lateral reinforcing ribs, said hoist including first support assembly having means for engaging one of said end flanges of one of said forms, column means rigidly connected to said first support assembly and extending above and below said one of said end flanges of said form when said first support assembly is mounted thereon, sheave support means connected to the upper end of said column means and in spaced relation from said first support assembly, said sheave support means extending perpendicularly to said column means and substantially parallel to said first support assembly, second support means rigidly connected to the lower end of said column means and selectively mountable between the side flanges of said one of said forms in a selected position, cable supply means mounted on said support means, said sheave support means having an inner portion and an outer portion, a first sheave mounted to said inner portion in vertical alignment with said cable supply means, a second sheave mounted to said outer portion in horizontally spaced relationship to said first sheave, said cable supply means having a cable extending upwardly around said first and second sheaves and downwardly and positionable to engage a second of said forms located alongside said one of said forms, and engaging means carried by said cable to engage said second form.

10. The invention of claim 9, in which said side and end flanges and said ribs have spaced openings, connecting pins selectively insertable in said openings, said first support assembly having fixed finger means adapted to be received in openings in said one of said end flanges for positioning said first support assembly thereon, said first support assembly having adjustable finger means which extend across said one of said end flanges and overhanging downwardly therefrom, in one position, for holding said first support assembly on said end flange during erection of a form, and being swingable to a second position during removal from said forms.

* * * * *